US005575685A

United States Patent [19]

Ittah et al.

[11] Patent Number: 5,575,685

[45] Date of Patent: Nov. 19, 1996

[54] ELECTRICAL CONNECTORS

[75] Inventors: Jean Ittah, Villeneuve la Garenne; Thierry Badaroux, Saint-Germain en Laye, both of France

[73] Assignee: Connecteurs Cinch, Montigny le Bretonneux, France

[21] Appl. No.: 546,893

[22] Filed: Oct. 23, 1995

[30] Foreign Application Priority Data

Oct. 27, 1994 [FR] France ..... 94 12895

[51] Int. Cl.[6] ..... H01R 13/514

[52] U.S. Cl. ..... 439/595; 439/488

[58] Field of Search ..... 439/752, 595, 439/488, 489

[56] References Cited

U.S. PATENT DOCUMENTS

| | | | |
|---|---|---|---|
| 4,944,688 | 7/1990 | Lundergan | 439/275 |
| 4,973,268 | 11/1990 | Smith et al. | 439/595 |
| 4,986,758 | 1/1991 | Wakata | 439/595 |
| 4,998,896 | 3/1991 | Lundergan | 439/595 |
| 5,211,583 | 5/1993 | Endo et al. | 439/595 |
| 5,281,168 | 1/1994 | Krehibiel et al. | 439/595 |

FOREIGN PATENT DOCUMENTS

| | | |
|---|---|---|
| 0330436 | 8/1989 | European Pat. Off. . |
| 0388489 | 9/1990 | European Pat. Off. . |
| 0420010 | 4/1991 | European Pat. Off. . |

*Primary Examiner*—Gary F. Paumen
*Assistant Examiner*—T. C. Patel
*Attorney, Agent, or Firm*—Greenblum & Bernstein P.L.C.

[57] ABSTRACT

Electrical connector assembly comprising a first housing member and a second housing member complementary to the first housing member, the second housing member having a series of passages in each of which a female electrical contact member is inserted. The first housing member includes a series of passages each adapted to receive a male electrical contact member, with the male electrical contact member having a contact part adapted to be inserted into a corresponding female contact member of the second housing member, a body including notches and elements for fixing an electrical conductor. The first housing member includes a face and a second projection on the face adapted to face towards the second housing member. The locking key is mounted on the first housing member on the side of the face adapted to face towards the second complementary housing member and includes a series of slots through which the contact parts of the male electrical contact members and an inclined resilient strip pass and near which an opening is provided for the second projection. The second housing member is provided with a housing adapted to receive the second projection, and the resilient strip is mounted so that in the pre-locked position of the key the resilient strip opposes engagement of the second projection in the housing whereas in the locked position of the key the second projection cooperates with the resilient strip to retract the resilient strip so that the second projection can be engaged to assemble the housing members.

3 Claims, 7 Drawing Sheets

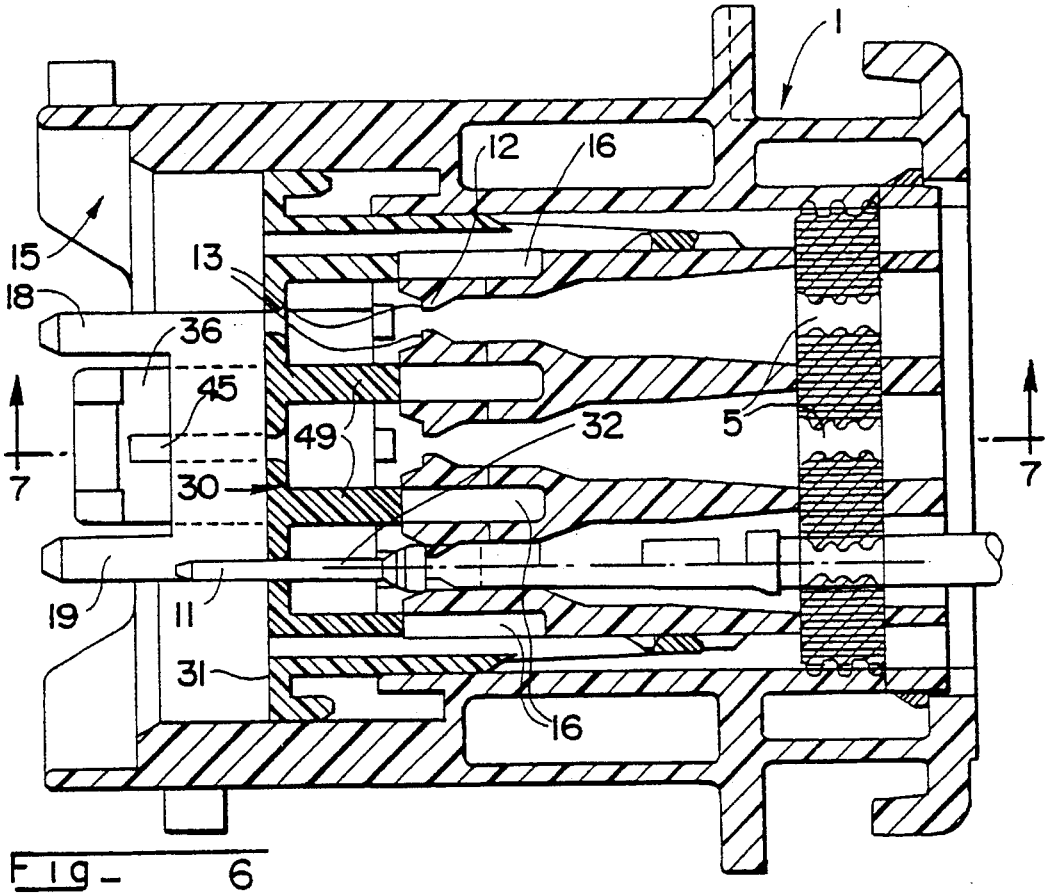
Fig- 6
Fig- 7
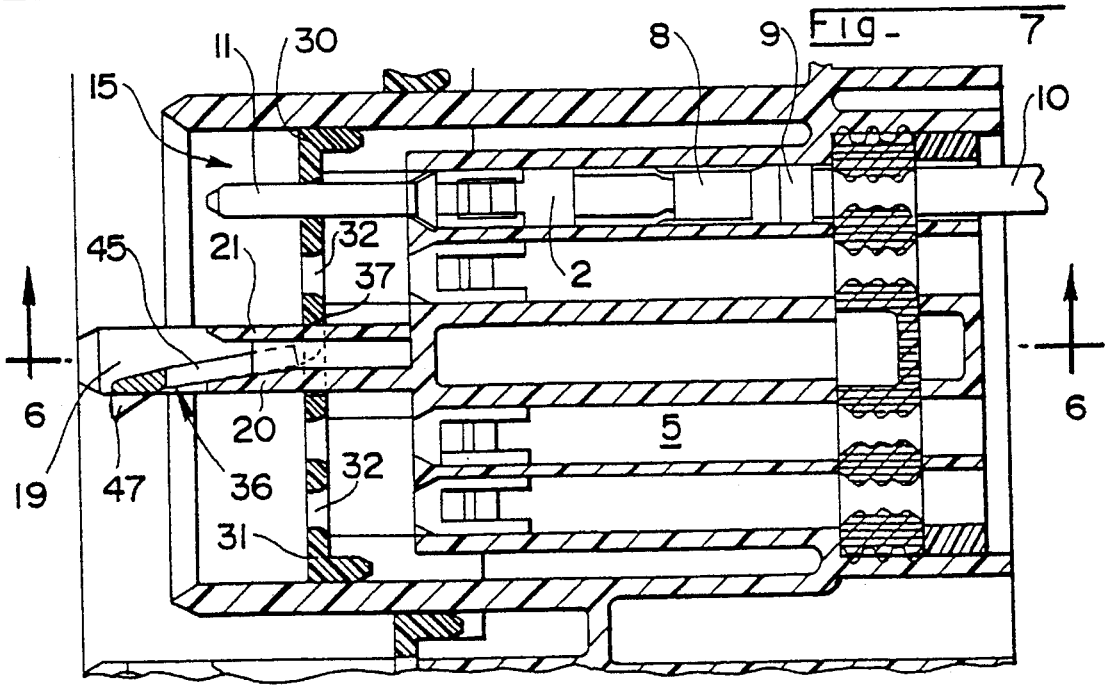

ELECTRICAL CONNECTORS

BACKGROUND OF THE INVENTION

1. Field of the Invention

The present invention concerns improvements to electrical connectors.

The invention relates to electrical connectors comprising a first housing member with a series of passages into each of which a male electrical contact member is inserted and a complementary second housing member with a series of passages each receiving a female electrical contact member, the housing members being adapted to be assembled together with the male members inserted in the female members.

2. Description of the Prior Art

In connectors of this kind the male members are retained in the passages by locking members formed by resilient tangs having projections adapted to cooperate with notches in the male members.

To prevent the housing members being assembled together if the male members are not properly inserted into the passages, in order to prevent any possibility of incorrect electrical connections, locking keys have been provided that can only be fitted if the position of the resilient tangs corresponds to locking of the male members. An arrangement of this kind confers good safety but in some cases this is insufficient.

An object of the present invention is to enhance safety.

SUMMARY OF THE INVENTION

The improvements in accordance with the invention are directed to improving electrical connectors having a first housing member and a second housing member complementary to the first housing member, the latter having a series of passages in each of which a female electrical contact member is inserted, the first housing member including a series of passages each adapted to receive a male electrical contact member having a contact part adapted to be inserted into a corresponding female contact member of the complementary housing member, a body provided with notches and means for fixing an electrical conductor, each passage including at least one locking member formed by a resilient tang having at least one projection adapted to be inserted in the notch of the male electrical contact member, slots being provided between the locking members to receive studs of a locking key, means being provided for holding the locking key in at least two positions, namely a pre-locked position in which the studs are separated from the slots so that the locking members can move without restriction to enable the fitting of the male electrical contact members and a locked position in which the studs are inserted in the slots to lock the locking members, which improvements consist in the following features: the first housing member has a projection on the face adapted to face towards the complementary housing member, the locking key being mounted on the first housing member on the side of the face adapted to face towards the complementary housing member and having a series of slots through which the contact parts of the male electrical contact members pass and an inclined resilient strip pass and near which an opening is provided for the projection, the complementary housing member having a housing adapted to receive the projection, the resilient strip being mounted so that in the pre-locked position of the key it opposes engagement of the projection in the housing whereas in the locked position of the key the projection cooperates with the resilient strip to retract the latter so that the projection can be engaged in the housing to assemble the housing members.

With an arrangement of this kind, assembly of the two housing members is impossible if the key is not in the locked position.

The projection also facilitates relative guidance of the assembly and a complementary housing member and this prevents incorrect offering up of the housing member causing deformation of the contact part of the male electrical contact members.

According to one constructive feature, the projection includes two strips connected by a web. A heel on one face of the projection is fastened to an elongate plate and the resilient strip has a slot near its end joining the corresponding face of the key and adapted to have the plate and the rib passed through it, together with a slot through which the rib passes. Accordingly, the resilient strip cannot be forced.

Finally, the face of the resilient strip adapted to face towards the corresponding face of the web has protuberances near its free end.

The invention will now be described in more detail with reference to a specific embodiment shown by way of example only in the appended drawings.

BRIEF DESCRIPTION OF THE DRAWINGS

FIG. 6 is a view in section on the line 6—6 in FIG. 7.

FIG. 7 is a view in section on the line 7—7 in FIG. 6.

DETAILED DESCRIPTION OF THE PREFERRED EMBODIMENT

Figure 1:
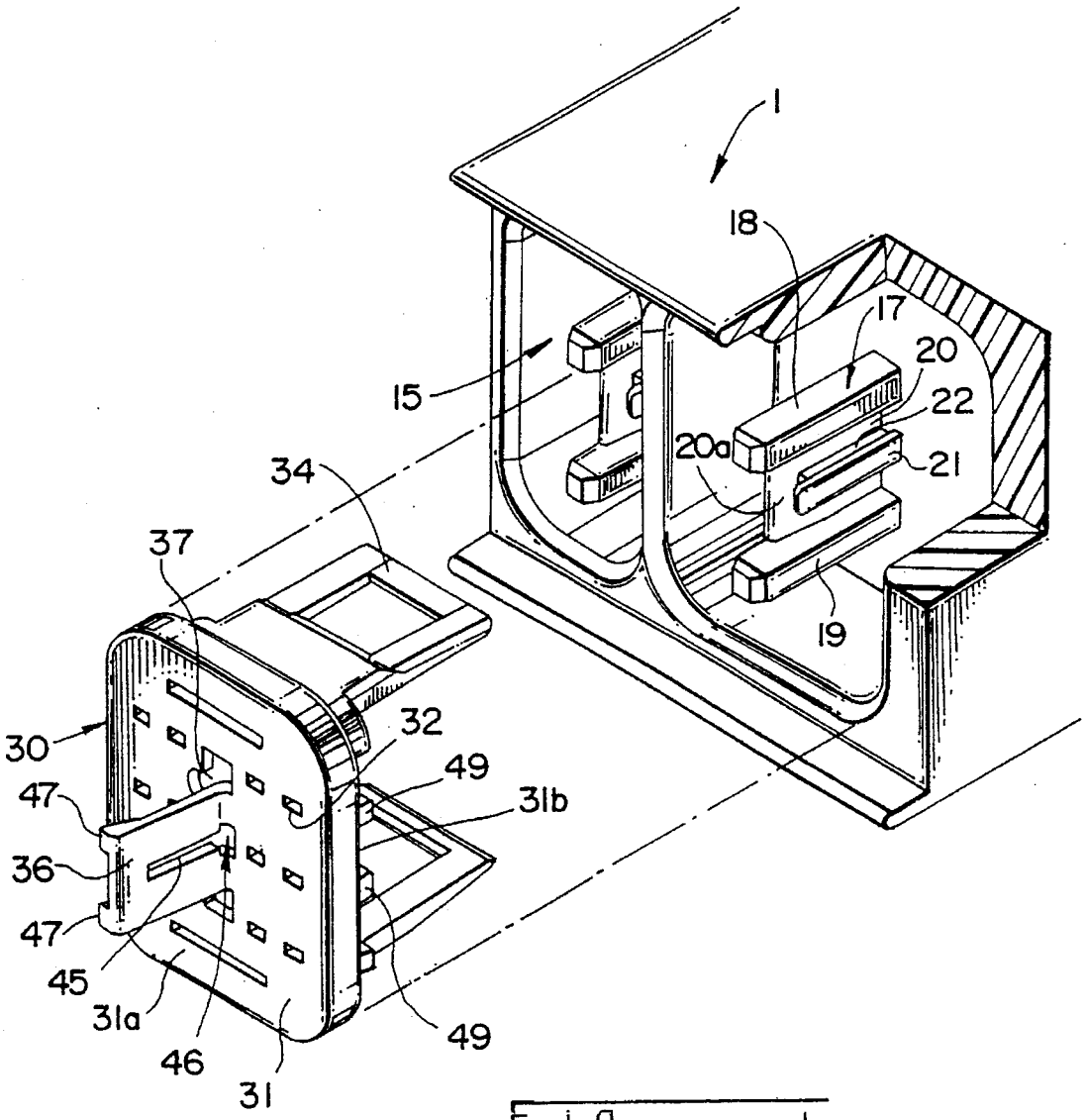
FIG. 1 is a perspective view of the key in accordance with the invention.

The figures show a first housing member 1 adapted to receive electrical contact members 2 adapted to cooperate with female electrical contact members 3 in a complementary second housing member 4.

The housing member 1 can be made up of modular elements, each comprising a series of passages 5 each adapted to receive a male member 2.

Each male member 2 has a body with, at one end, a contact part 11 adapted to cooperate with a female member 3 and, at the other end, lugs 8 and 9 for crimping an electrical conductor 10.

The body includes, part way along its length, notches 7 adapted to cooperate with locking members 12 of the housing member 1.

The locking members 12 are resilient tangs incorporating projections 13 adapted to be inserted in the notches 7 to lock said members 2.

The housing member 1 has slots 16 at the end 15 adapted to cooperate with the complementary housing member 4.

The central part of the housing member 1 at the end 15 incorporates a projection 17 featuring two strips 18 and 19 connected by a web 20 from the middle part of which a rib 22 ending at an elongate plate 21 extends along a face 20*a*.

FIG. 1 shows a locking key 30. The key 30 has a wall 31 with holes 32 through which the parts 11 pass. The projection 17 passes through an opening 37 in its central part, a resilient strip 36 extending along one edge of this opening and projecting from the surface of one face 31*a* of the key 30.

Along two opposite edges of a face 31*b* of the key 30 are stirrup members 34 adapted to cooperate with projections 39 and 40 on the corresponding inside walls of the housing member 1.

Figure 2:
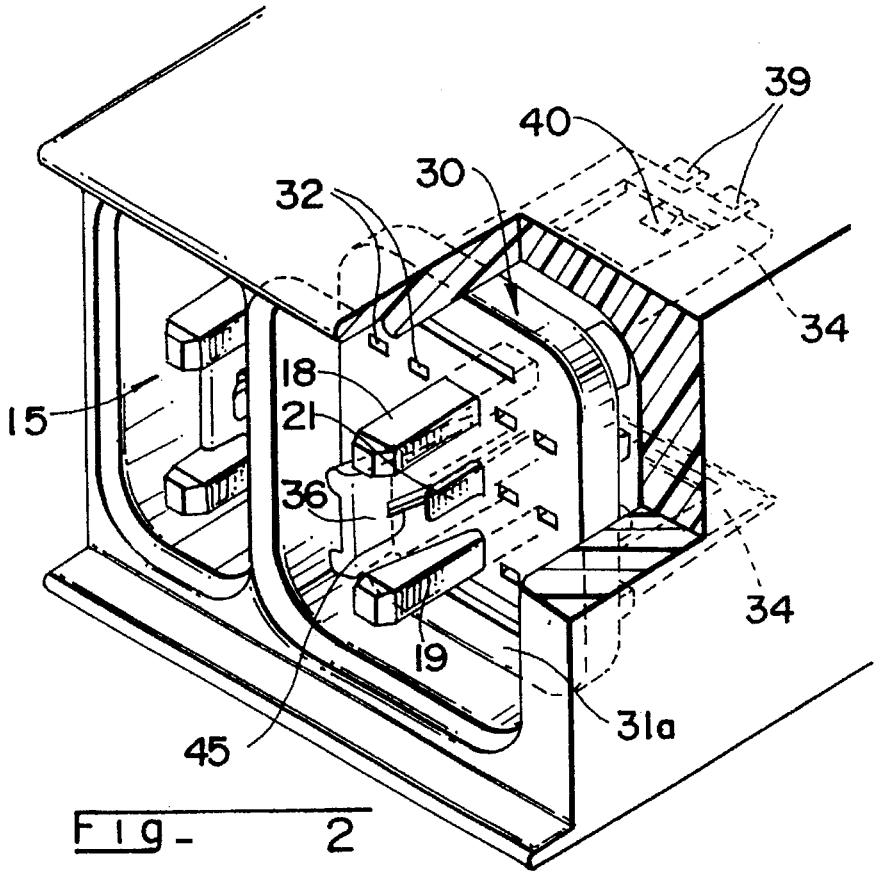
FIG. 2 is a perspective view showing the key of the invention in a pre-locked position.
Figure 3:
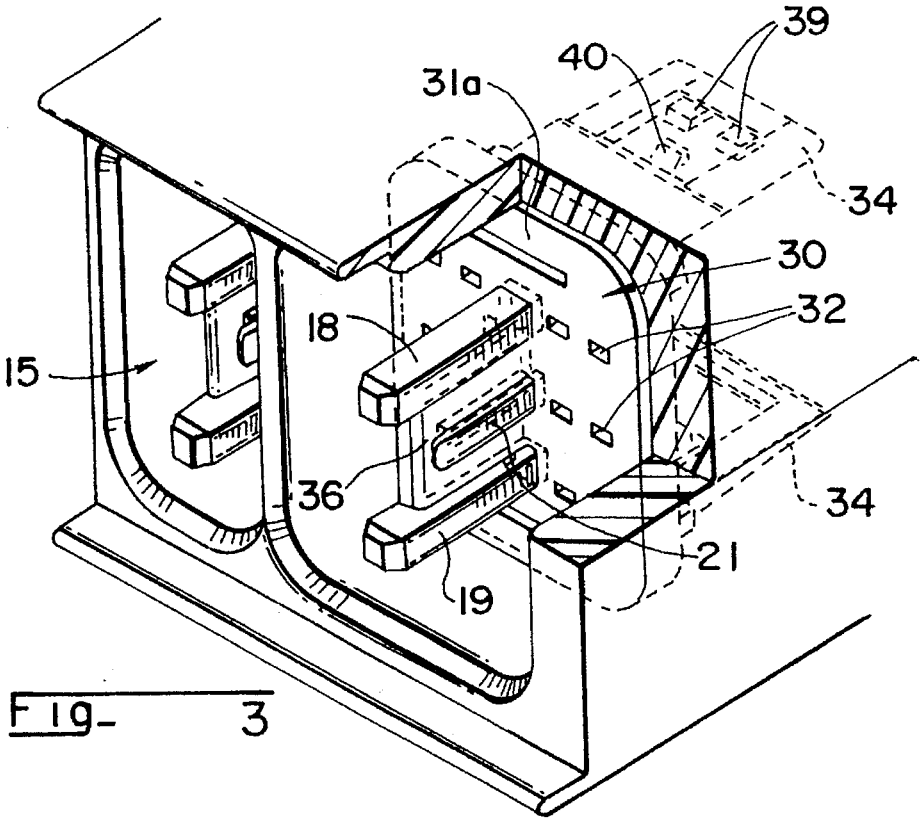
FIG. 3 is a perspective view showing the key in a locked position.
Figure 5:
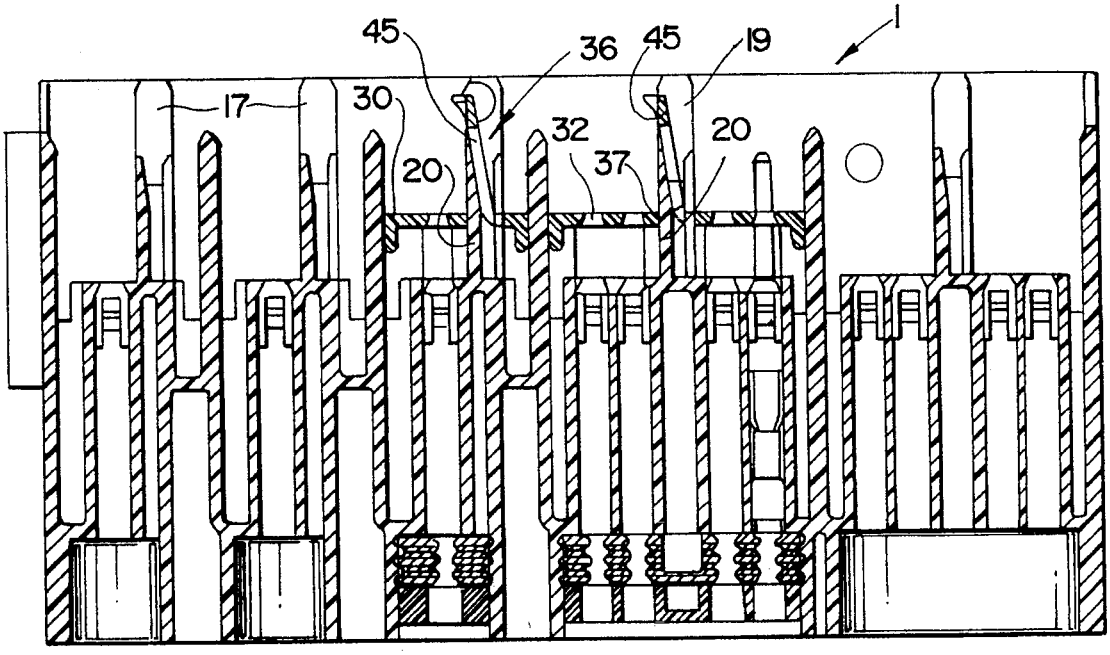
FIG. 5 is a view in section on the line 5—5 in FIG. 4.
Figure 4:
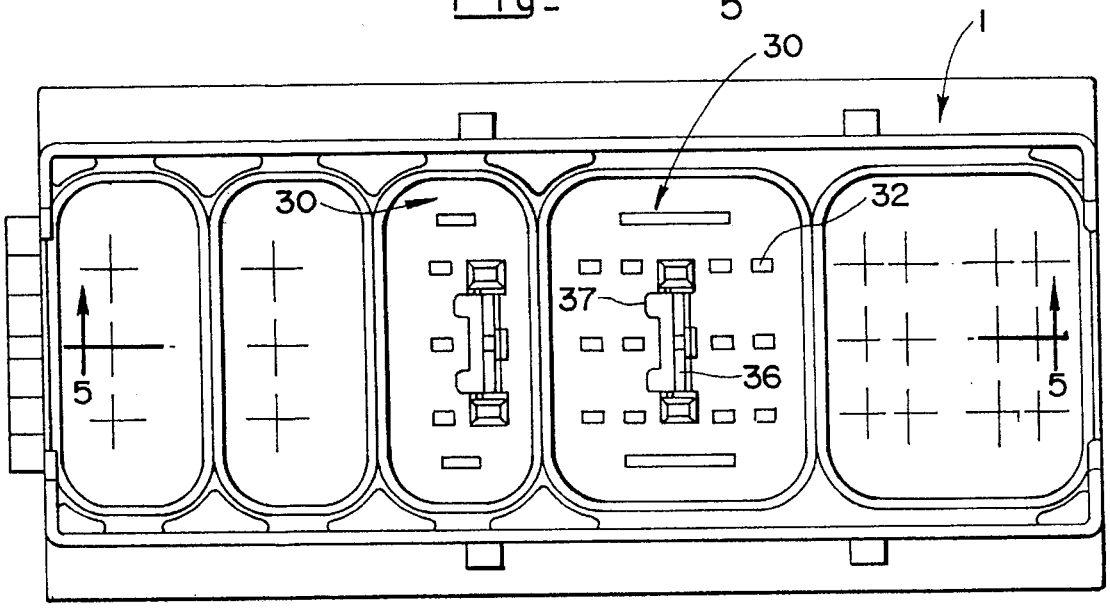
FIG. 4 is a plan view showing a housing member.

The projections 39 and 40 are disposed so that when the free end of the stirrup members 34 abuts against the projections 39 and is retained by the projections 40 the key 30 is in a pre-locked position (FIG. 2), whereas when the inside edge of said free end of the stirrup members 34 bears against the projections 39 the key 30 is in the locked position (FIG. 3).

The resilient strip 36 has a slot 45 with dimensions matching those of the rib 22 and a slot 46 through which the plate 21 passes.

At the free end on the face facing towards the opening 37 the resilient strip 36 has two protuberances 47.

The face 31*b* of the key 30 is provided with studs 49 adapted to be inserted into the slots 16.

Figure 10:
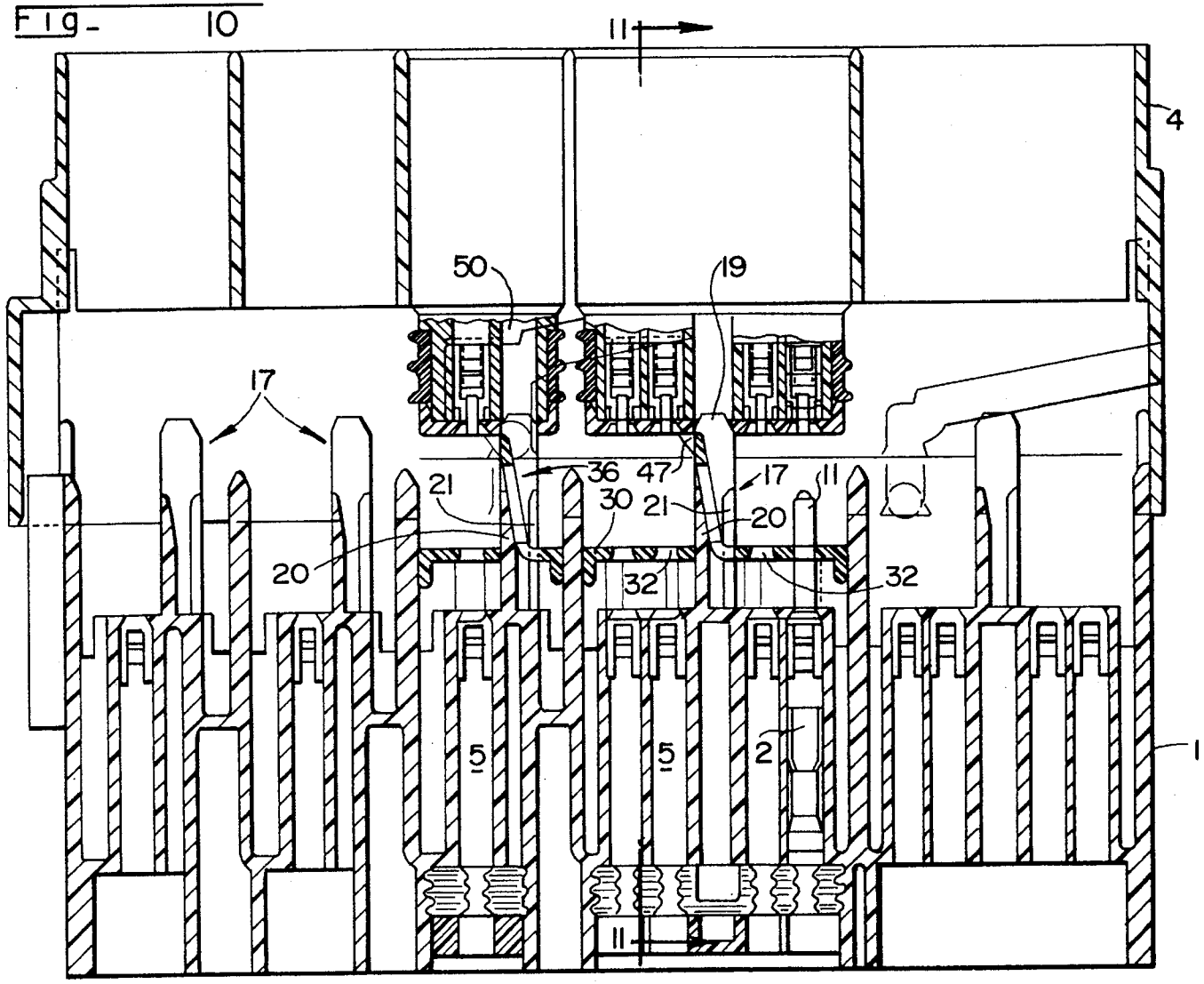
FIG. 10 is a view in section on the line 10—10 in FIG. 11.

As shown in FIG. 10, the complementary housing member 4 includes housings 50 adapted to receive the projections 17.

In the prelocked position (see FIGS. 2 and 6) the studs 49 are not engaged in the slots 16 with the result that the locking members 12 can move freely, and the members 2 can be fitted into the passages 15 so that the projections 13 cooperate with the notches 7 to lock said members.

Obviously, if a member 2 is not correctly inserted into the corresponding passage the corresponding locking member 12 will lie in the corresponding slot 16, the stud 49 cannot be inserted into said slot 16 and the key 30 cannot be locked.

Figure 11:
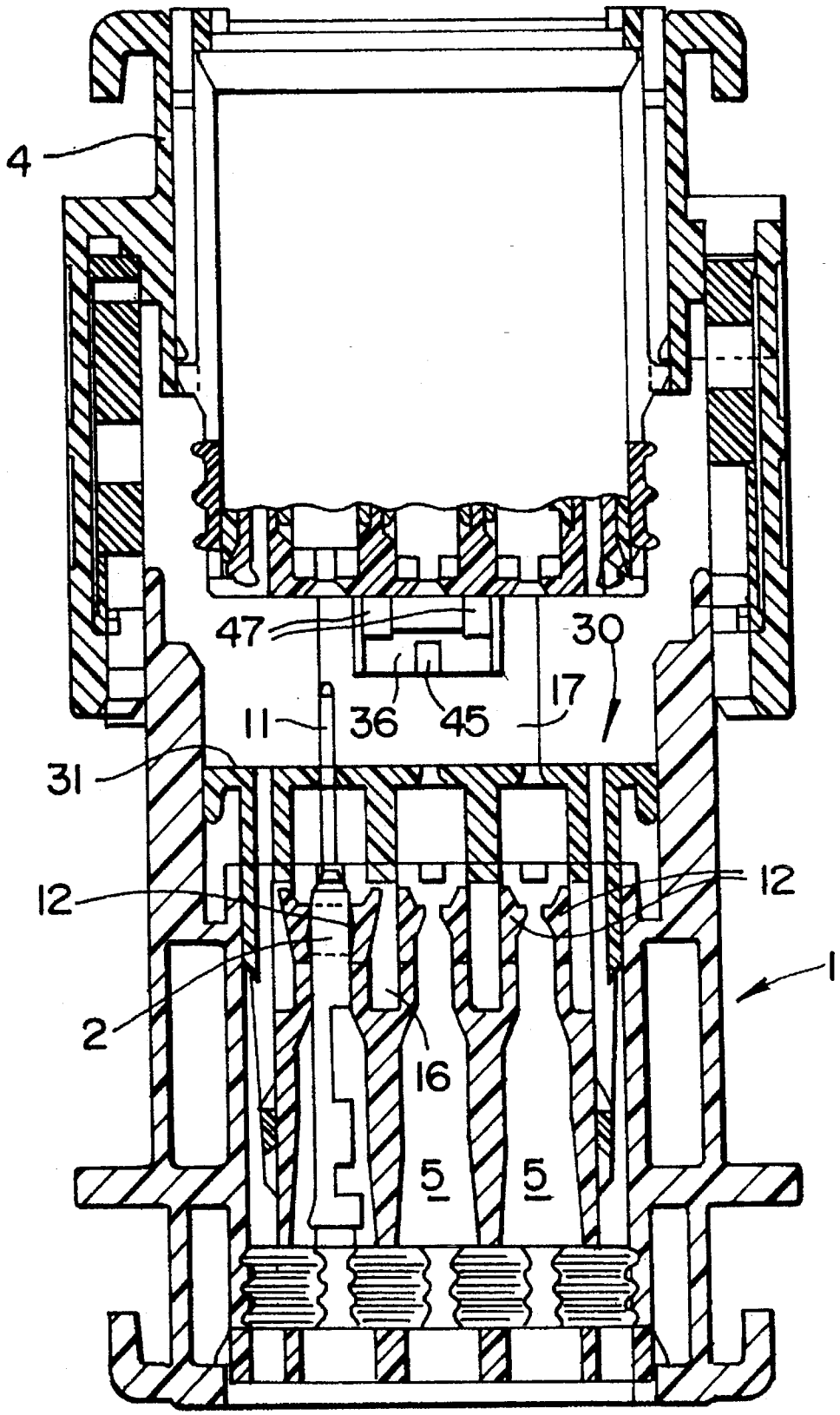
FIG. 11 is a view in section on the line 11—11 in FIG. 10.

The resilient strip 36 is slightly inclined and in the prelocked position of the key 30 is outside the plane of the strips 18 and 19 (see FIG. 2). As shown in FIGS. 10 and 11, if mounting of the complementary housing member 4 onto the housing member 1 is attempted, the protuberances 47 abut against said complementary housing member 4 near the edge of the housing 50 and therefore the two housing members cannot be assembled together.

Figure 8:
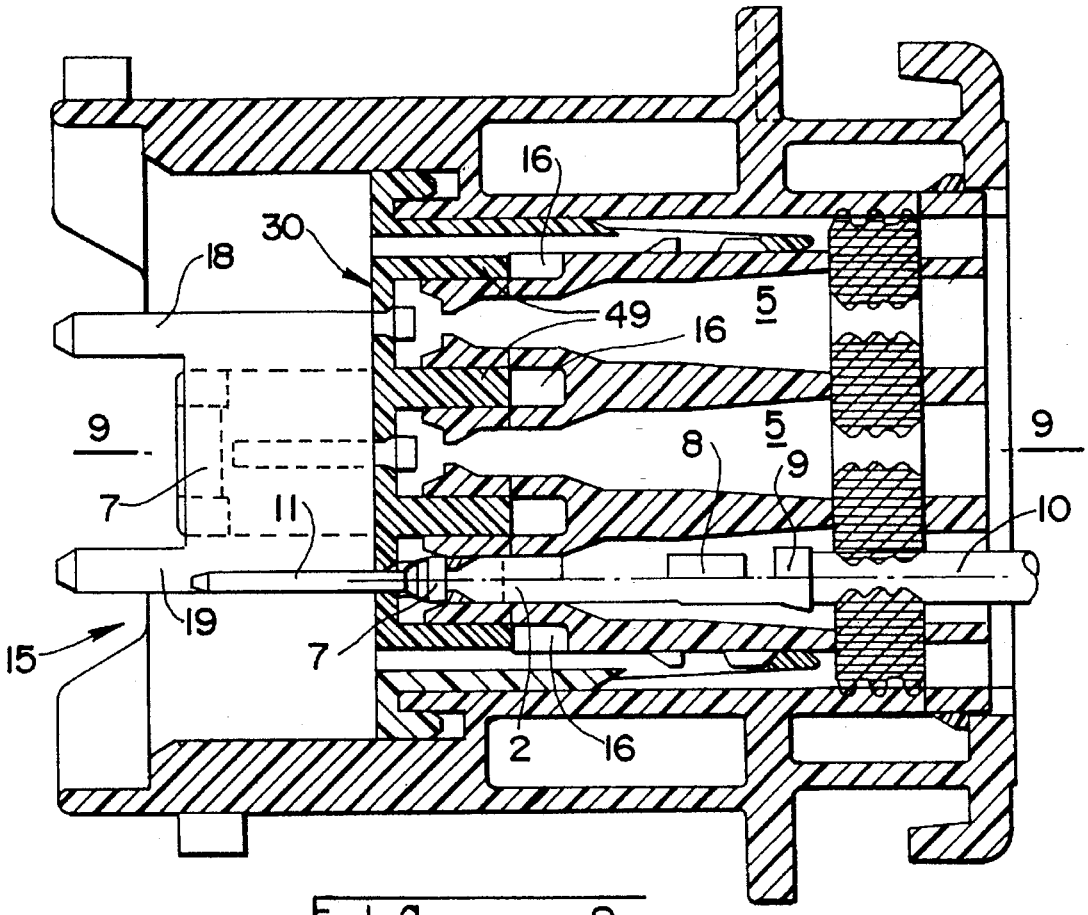
FIG. 8 is a view in section on the line 8—8 in FIG. 9.
Figure 9:
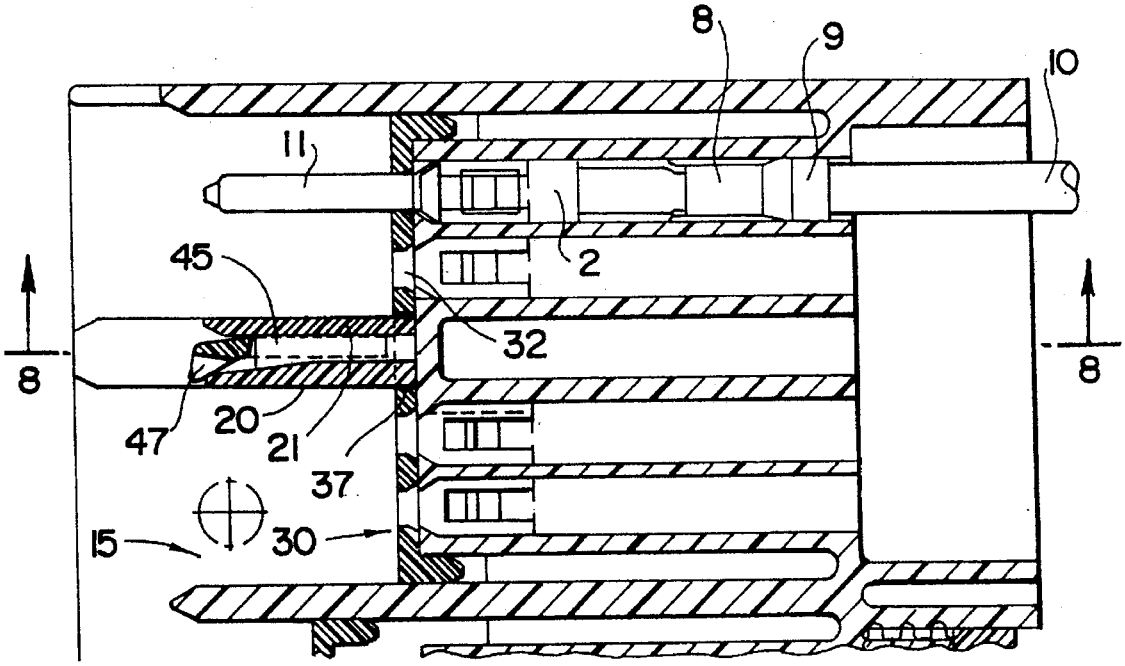
FIG. 9 is a view in section on the line 9—9 in FIG. 8.

When the key 30 is in the locked position (see FIGS. 3, 8 and 9), the studs 49 are inserted in the slots 16 with the result that the members 12 are locked and the protuberances 47 on the resilient strip 36 bear against the face 20*a* of the web 20, the rib 22 inserted in the slot 45 and the plate 21 locks the resilient strip which is therefore protected and cannot be forced.

It will be therefore realised that the housing member 1 can be assembled to the complementary housing member 4 only if the electrical contact members 2 are locked in place.

Of course, the invention is not limited to the embodiment just described and shown. Many modifications of detail can be made thereto without departing from the scope of the invention.

There is claimed:

1. Electrical connector assembly comprising a first housing member and a second housing member complementary to said first housing member, the second housing member having a series of passages in each of which a female electrical contact member is inserted, said first housing member including a series of passages each adapted to receive a male electrical contact member; said male electrical contact member having a contact part adapted to be inserted into a corresponding female contact member of said second housing member, a body including notches and means for fixing an electrical conductor, each passage including at least one locking member formed by a resilient tang having at least one first projection adapted to be inserted in said notch of said male electrical contact member, slots being provided between said locking members to receive studs of a locking key, means for holding said locking key in at least two positions, said two positions comprising a pre-locked position in which said studs are separated from the slots so that said locking members can move without restriction to enable the fitting of said male electrical contact members and a locked position in which said studs are inserted in said slots to lock said locking members, said first housing member including a face and a second protection on the face adapted to face towards said second housing member, said locking key being mounted on said first housing member on the side of said face adapted to face towards said second housing member and having a series of slots through which said contact parts of said male electrical contact members and an inclined resilient strip pass and near which an opening is provided for said second projection, said second housing member having a housing adapted to receive said second projection, said resilient strip being mounted so that in said pre-locked position of said key said resilient strip opposes engagement of said second projection in said housing whereas in said locked position of said key said second projection cooperates with said resilient strip to retract the resilient strip so that said second projection can be engaged in said housing to assemble said housing members.

2. The electrical connector assembly according to claim 1 wherein said second projection includes two strips connected by a web on one face of which is a rib fastened to an elongate plate and said resilient strip has a slot near its end joining the corresponding face of said key and adapted to have said plate and said rib passed through it, together with a slot through which said rib passes.

3. The electrical connector assembly according to claim 1 wherein the face of said resilient strip adapted to face towards the corresponding face of said web has protuberances near its free end.

* * * * *